US006545213B1

(12) United States Patent
Gabriel

(10) Patent No.: US 6,545,213 B1
(45) Date of Patent: Apr. 8, 2003

(54) METHOD AND PRODUCT FOR REDUCING DISTORTION IN AN AUDIO OR HOME THEATER CABLE

(76) Inventor: Caelin Gabriel, 7755 Long Lake Rd., Port Orchard, WA (US) 98366

( * ) Notice: Subject to any disclaimer, the term of this patent is extended or adjusted under 35 U.S.C. 154(b) by 0 days.

(21) Appl. No.: 09/454,228

(22) Filed: Dec. 2, 1999

(51) Int. Cl.[7] ..... H01B 11/02
(52) U.S. Cl. ..... 174/36; 174/113 R
(58) Field of Search ..... 174/36, 116, 113 R, 174/96, 98, 99 R, 102 P, 102 D

(56) References Cited

U.S. PATENT DOCUMENTS 3,914,181 A * 10/1975 Berg et al. ..... 252/62.1
4,689,443 A * 8/1987 Bailleul ..... 174/102 P
4,777,324 A * 10/1988 Lee ..... 174/113 R
4,920,233 A * 4/1990 Kincaid ..... 174/36
5,698,615 A * 12/1997 Polle ..... 174/24 X

OTHER PUBLICATIONS

Hawley, "Condensed Chemical Dictionary" p. 314, 1981.*

* cited by examiner

*Primary Examiner*—Chau N. Nguyen
(74) *Attorney, Agent, or Firm*—Risto A. Rinne, Jr.

(57) ABSTRACT

A method and product for reducing distortion in an audio cable includes a flexible outer conduit and at least one electrical conductor (i.e. wire) disposed in the conduit along its longitudinal length. A granular or beaded ferro-electric substance is disposed in the conduit along its longitudinal length. The electrical conductor is surrounded by (i.e., immersed in) the ferro-electric substance along its length and extends from each end of the cable and may include whatever termination is desired to connect the electrical conductor to a component part of an audio or home theater system. A seal is provided at each end of the audio cable to retain the ferro-electric substance. Preferred ferro-electric substances include generally spherically shaped beads of silica gel or rochelle salts of combinations thereof.

7 Claims, 1 Drawing Sheet

METHOD AND PRODUCT FOR REDUCING DISTORTION IN AN AUDIO OR HOME THEATER CABLE

RELATED PATENT APPLICATION

The present application is related to a prior currently pending patent application filed by the same inventor on Oct. 28, 1998, application Ser. No. 09/181949.

BACKGROUND OF THE INVENTION

1. Field of the Invention

The present invention, in general, relates to audio equipment and, more particularly, to audio cables used to supply a signal to speakers and other audio or home theater components.

In any acoustic type of system, such as a stereo or a surround-sound system or a home-theater system or even an amplified live source of music, one or more speakers are required to produce (or reproduce) that sound that is being listened to.

In addition, with any type of an acoustic system the quality of the sound that is ultimately produced is a function of each component of the acoustical system. For example, great speakers will not produce great sound if an inferior amplifier is used. An audio system is like a "chain" in which the "weak link" determines—by way of limitation—the quality of sound that can be produced.

Therefore, the quest for superb quality sound has driven the market inducing it to improve every component of an acoustical system. It has long been known that the audio cables that supply the electrical signal and power from an amplifier to the speakers are critical components.

For example, if the electrical conductors that are used to form the audio cables are too small for the speakers and amplifier that are used, then power will be lost in the audio cables (by way of increased electrical resistance and a resulting voltage drop) and the sound that will be reproduced by the speakers, in particular the lower frequency sounds, will be adversely affected.

Manufacturers are adept at compensating for such needs by offering a variety of sizes for the electrical conductors in the audio cables that they manufacture and in helping audiophiles match the size of the conductors in the audio cables with the power requirements of the acoustical system (also known as an audio system).

However, another limitation that affects the sound quality of the audio system is the quality of the signal that is supplied to the speaker. A speaker is essentially a "dumb" transducer. It simply moves in response to the characteristics of the electrical waveform that drives it. It is a linear motor that moves back and forth as a result of magnetic attraction and repulsion. In general, the design and functioning of speakers is well understood in the audio arts.

However, it is important that the electrical waveform that drives each speaker be as perfect or as pure as possible. Deviation away from the ideal is, in general, referred to as "distortion" It is sometimes also called "noise".

If distortion is present in the waveform, the "dumb" speaker, having no way to differentiate distortion apart from music, will simply respond to the distortion that is present in the electrical waveform that is being supplied to it and it will, accordingly, reproduce it. Distortion is not pleasant to listen to.

The electrical components selected for every component, from tuner and preamplifier to power amplifier and including the audio cables that are used are designed to minimize distortion.

However, when an electrical current is being propagated through a conductor various distortions are produced in response to the flow of current through the conductor. These responses include the generation of an electromagnetic field around the audio cables themselves. This effect has been discounted in the past, mostly because audio engineers have been unable to remedy the situation, and also in part because the deleterious effects have not been understood or well appreciated.

However, as the quality of audio systems has improved generally, the resulting sound that is produced by these systems has increasingly become purer. A good (pure) sounding audio system is sometimes referred to as being a "clean" system. The "cleaner" the sound has become, the more noticeable have become other sources of distortion, previously not appreciated.

Accordingly, this is currently the reason that both audiophiles and audio design engineers have begun to take note about reducing the distortions that occur in audio cables. Audiophiles are willing to pay a premium to purchase audio cables if they can further ameliorate the deleterious sources of distortion.

The electromagnetic fields that are produced by the audio cables themselves combine with the electromagnetic fields that are produced by the audio cables at various locations along the length of the cable. This is because audio cables are not placed in a perfectly straight line but include curves and sometimes even loops to use up extra cable length.

The electromagnetic fields constructively and destructively interfere with each other and with the original waveform (i.e., the output from the power amplifier). The result is to alter the original electrical waveform before it reaches the speakers and to produce an impure, distorted sound.

The alteration of the original waveform that is supplied to the speakers is another form of distortion that affects the sound quality that is ultimately reproduced by the speakers. This is because the constructive interference produces an electrical waveform to the speaker that is greater than that which the original electrical signal called for. Conversely, any destructive interference produces a waveform that is diminished from that of the original.

The electromagnetic emissions by the audio cables can further interfere with and degrade the performance of other audio components, such as that of the preamplifier, tuner, power amplifier, speakers, etc.

In addition to the electromagnetic interference so produced, there are other anomalous forms of energy that are hypothesized to be produced within the audio cables that emanate therefrom. These energies are not presently well understood, but include perhaps sound and heat and mechanical distortions, and sometimes, it is further speculated, they operate at the molecular level. Additional research, perhaps in the quantum physics arena, will shed more light on the various causes and effects of various energies and their interactions that further contribute to the generation of distortion.

With the present level of limited understanding regarding all of the possible causes, distortion still occurs (for whatever reasons) and it remains desirable to mitigate its effect, especially in audio cables.

Furthermore, electromagnetic interference inherently arises from all sources that consume electrical energy. For example, electromagnetic and perhaps other types of radiation, emanate from each component of an audio system. The electromagnetic energy, for example, that is emitted by the power amplifier radiates out from the power amplifier and enters the conductors in the audio cables, producing further distortion.

The distortion in the audio cables comes, in part, from the components that supply the original waveform and so the original waveform is inherently impure to at least some degree. Additional distortion arises from the electromagnetic emissions (i.e. radiation) from these (and other) components that are, in turn, received by the audio cables. This is because the audio cables function as antennas. While conventional shielding techniques provide some relief they are not effective at limiting distortions that are produced within the audio cable itself.

Another problem with audio cables is that the larger diameter cables are especially difficult to bend sharply. A short radius bend (i.e., a sharp bend) is required when the audio cable is connected to an audio system component, such as to an amplifier or to a speaker. In particular, the presently disclosed invention tends to further increase the diameter of the audio cable. As such, a solution to allow tighter bends in large diameter audio cables is a desirable feature to attain.

Accordingly, there exists today a need for an method and product for reducing noise and distortion in an audio cable, an audio power cable, an audio interconnect, a speaker cable, or any cable or wire that is used in an audio or home theater system to interconnect component parts. Clearly a method and product useful to lessen the distortion that is produced by an audio cable and which can help prevent the audio cable from receiving distortions from other sources is a useful and desirable device.

2. Description of Prior Art

Audio cables are, in general, well known. Increasing the size of the electrical conductor and shielding are presently known methods of reducing distortion in an audio cable.

U.S. Pat. No. 5,814,761 to Piazza that issued on Sep. 29, 1998 deals with a passive EMI dissipation apparatus and method.

While the structural arrangements of the currently known devices and methods, at first appearance, have similarities with the present invention, they differ in material respects. These differences, which will be described in more detail hereinafter, are essential for the effective use of the invention and which admit of the advantages that are not available with the prior devices and methods.

OBJECTS AND SUMMARY OF THE INVENTION

It is an object of the present invention to provide a method and product for reducing distortion in an audio cable that is effective at reducing noise and distortion produced by the audio cable itself.

It is also an important object of the invention to provide a method and product for reducing noise and distortion in an audio cable that is effective at reducing noise and distortion that is produced by other sources and received by the audio cable.

Another object of the invention is to provide a method and product for reducing noise and distortion in an audio cable that is effective at reducing the high frequency electromagnetic energy radiated outward by an audio cable.

Still another object of the invention is to provide a method and product for reducing noise and distortion in an audio cable that is effective at reducing noise and distortion levels that reach a speaker.

Still yet another object of the invention is to provide a method and product for reducing noise and distortion in an audio cable that produces a cleaner sound.

Yet another important object of the invention is to provide a method and product for reducing noise and distortion in an audio cable that is inexpensive to manufacture.

Still yet another important object of the invention is to provide a method and product for reducing noise and distortion in an audio cable that can be readily bent along a radius.

An especially useful object of the invention is to provide a method and product for reducing noise and distortion in an audio cable that provides a termination to an audio cable that can be bent around a tight radius.

A further especially useful object of the invention is to provide a method and product for reducing noise and distortion in an audio cable that facilitates connection of the audio cable to a component of an audio system.

Briefly, a method and product for reducing noise and distortion in an audio cable for use in an sound system that is constructed in accordance with the principles of the present invention has a flexible outer conduit and at least one electrical conductor disposed in the conduit. A granular ferro-electric substance is disposed in the conduit along its longitudinal length. The electrical conductor extends from each end of the cable and may include whatever termination is desired to connect the electrical conductor to a speaker or other component part of an audio or home theater system. A seal is provided at each end of the audio cable to retain the ferro-electric substance. A preferred ferro-electric substance includes generally spherically shaped beads of silica gel that provide improved flexing of the audio cable.

DETAILED DESCRIPTION. OF THE INVENTION

Figure 1:
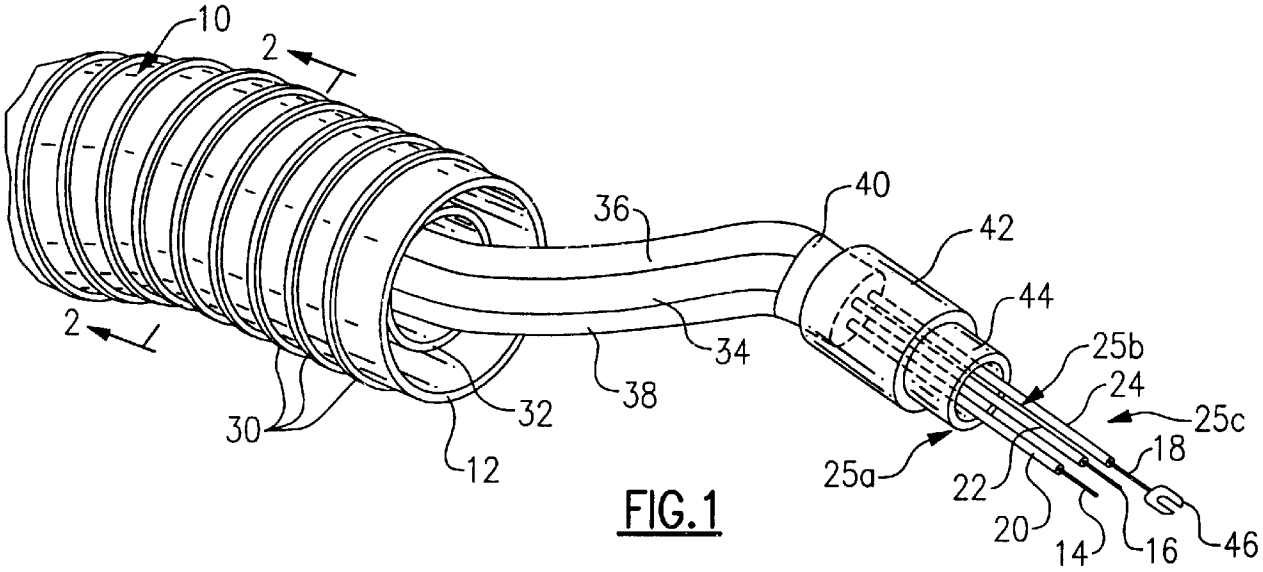
FIG. 1 is a view in perspective of an audio cable end.
Figure 2:
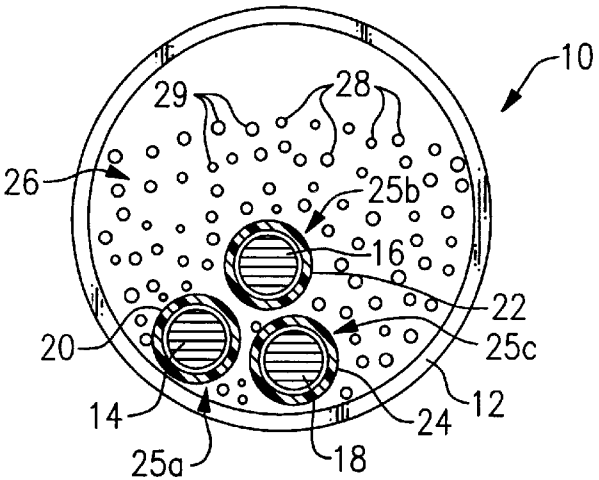
FIG. 2 is a cross sectional view taken on the line 2—2 in FIG. 1.

Referring to both FIG. 1 and FIG. 2 is shown an audio cable, identified in general by the reference numeral 10.

Referring now primarily to FIG. 2, a flexible outer conduit 12 is of any preferred inside and outside diameter.

It is typically made of either vinyl, nylon, polyethylene, polypropylene, or Teflon.

At a minimum, a first electrical conductor 14 is disposed inside of the outer conduit 12. As desired, a second electrical conductor 16 and a third electrical conductor 18 are also disposed inside of the outer conduit 12. Additional electrical conductors (not shown) may also be disposed inside of the outer conduit 12, if desired.

Each of the first, second, and third electrical conductors 14, 16, 18 are made of copper or any other preferred substance that is an effective electrical conductor.

A first insulating jacket 20 is used to surround and to electrically insulate the first electrical conductor 14. Similarly, a second insulating jacket 22 is used to surround and to insulate the second electrical conductor 16 and a third insulating jacket 24 is used to surround the third electrical conductor 18.

The first electrical conductor 14 inside of the first insulating jacket 20 forms a first wire, identified in general by the reference numeral 25*a*.

The second electrical conductor 16 inside of the second insulating jacket 22 forms a second wire, identified in general by the reference numeral 25*b*.

The third electrical conductor 18 inside of the third insulating jacket 24 forms a third wire, identified in general by the reference numeral 25*c*.

A granular ferro-electric substance, identified in general by the reference numeral 26 is disposed inside of the outer conduit 12 and surrounds the first, second, and third wires 25*a*, 25*b*, 25*c*.

As shown the ferro electric substance 26 may not surround all of the insulating jackets 20–24 because of shifting that occurs inside the outer conduit 12. The shifting includes shifting of the ferro-electric substance 26 or shifting of the first, second, and third wires 25*a*, 25*b*, 25*c*.

It is not mandatory that any of the first, second, and third wires 25*a*, 25*b*, 25*c* be surrounded at all times by the ferro-electric substance 26 in order to improve the quality of sound or to reduce distortion levels. The efficacy of "noise" reduction is a function of the quantity of the ferro-electric substance 26 that is used and its proximity to the first, second, and third wires 25*a*, 25*b*, 25*c*. A greater quantity of the ferro-electric substance 26 with as much immersion in the ferro-electric substance as is possible by the first, second, and third wires 25*a*, 25*b*, 25*c* is optimum.

When possible, it is preferable to surround as many as possible of the first, second, and third wires 25*a*, 25*b*, 25*c* by the ferro-electric substance 26 for as much of the longitudinal length of the conduit 12 as possible, but as mentioned hereinabove this is not mandatory. If it is desired, a plurality of centering rings (not shown) may be disposed inside of the outer conduit 12 at spaced apart intervals that surround and centrally dispose the first, second, and third wires 25*a*, 25*b*, 25*c* inside the outer conduit 12.

Experimentation has proven the efficacy of the methods and apparatus herein described even though the exact mechanism that produces the benefit is not known. It is believed that the ferro-electric substance 26 cooperates with the generated electromagnetic field that is produced in response to a flow of current through any of the first, second, and third wires 25*a*, 25*b*, 25*c* in some manner so as to dampen the waveform by reducing noise and distortion.

It is believed that absent this damping a spurious signal is generated that distorts the original waveform that is intended to supply signal and power to a speaker (not shown) or any other audio component. It is further speculated that because each type of the ferro-electric substance 26 to one degree or another is capable of the piezo-electric effect, that is to say it changes its shape when an electrical voltage is applied, that this phenomenon is related to its efficacy in purifying the audio signal. Perhaps the electromagnetic field induces a voltage internal to the ferro-electric substance 26 which then causes the ferro-electric substance 26 to physically deform converting electromagnetic energy into mechanical motion and, ultimately, into heat.

The deformation may serve to dissipate some of the radiated electromagnetic field energy as contained in certain frequency bands thus preventing its ability to radiate outward and either constructively or destructively interfere with the original waveform or with any other audio component of an audio system (not shown).

The ferro-electric substance 26 consists of either silica (silicon dioxide), rochelle salts (potassium sodium tartrate), quartz crystals, silica sand (99% pure), or fused silica. Barium titanate and related compounds such as lead titanate, calcium titanate, and lead zirconate are also ferro-electric substances as are ferro-electric ceramics, any of which (alone or in combination) may be used to form the ferro-electric substance.

Though it is possible to obtain some benefit if any of the above named substances are used, the preferred materials to form the ferro-electric substance 26 include silica gel beads, identified by the reference number 28 or rochelle salts, identified by the reference number 29. The silica gel beads 28 are also sometimes referred to as desiccant silica (typically 99.2% to 99.5% pure) and are generally spherical in shape.

The spherical shape permits the silica gel beads 28 to readily shift position in the outer conduit 12. This makes it easier to bend the outer conduit 12 and the first, second, and third wires 25*a*, 25*b*, 25*c* that are disposed therein. Accordingly, it is then easier to route the audio cable 10 around objects from, for example, a stereo amplifier (not shown) to a speaker (not shown) than it would be if other types of granular materials were used for the ferro-electric substance 26.

Furthermore, the silica gel beads 28 tend to naturally migrate around the first, second, and third wires 25*a*, 25*b*, 25*c* thereby increasing the amount of immersion experienced by the first, second, and third wires 25*a*, 25*b*, 25*c* in the ferro-electric substance 26.

The silica gel beads 28 are a colloidal form of silica, synthetically manufactured from sodium silicate. The silica gel beads 28 are glassy, hard, and somewhat irregularly shaped generally spherical granules that are clear to milky in color. They have an amorphous microporous structure providing a large surface area and a large number of microcrystalline structures and edge boundaries that provide improved performance. This is because the edge boundaries are believed to cause the radiated electromagnetic field to be diffracted, refracted, and reflected within the structures which aids in disrupting and dispersing the high frequency noise components.

Depending upon the application, either the rochelle salt 29 or the silica gel beads 28 are used (by themselves) to form the ferro-electric substance 26. For other applications, they may be combined together in any preferred ratio.

The formulation that is used affects the audio performance of the audio cable 10. The silica gel beads 28 end to improve the lower and mid audio frequencies (below 1 Khz) while the rochelle salts 29 are especially effective at the higher audio frequencies (above 1 Khz).

The diameter of the silica gel beads 28 that are used varies depending upon the size of the audio cable 10. Their size is commonly referred to as a "mesh" grade. A 1–3 mesh is often preferred and it includes the silica gel beads 28 having a diameter from 1–3 mm. For small interconnect cables a custom made size, of 16 mesh is preferred and it includes the silica gel beads 28 with a diameter that is less than 1 mm.

Another advantage of using the silica gel beads 28 is that they are porous to some extent (which is why they can also be used in other applications as a desiccant). The benefit derived for the present application is that they are lighter in weight, weighing about 70% that of regular granulated silica. This reduces the weight of the audio cable 10 by about 30%.

The larger the inside diameter of the outer conduit 12, the greater the amount of ferro-electric substance 26 that can be disposed therein. This allows for larger sizes for the first, second, and third wires 25*a*, 25*b*, 25*c* as well.

A larger diameter for the outer conduit makes it more difficult to bend. This effect can be offset by using a corrugated material 30 (i.e., ribbed or convoluted) for the outer conduit 12. The use of the corrugated material 30 is generally preferred whenever the outside diameter of the outer conduit 12 equals or exceeds one-half of an inch.

It is of course necessary to seal the ends of the outer conduit 12 in order to retain the ferro-electric substance 26 therein. Any type of a sealant, such as a glue (not shown) or a putty (not shown) or any type of a filler material (not shown) may be used for this purpose as desired. Preferred glues include silicon glue and hot melt glue.

However, if the size of the first, second, and third wires 25*a*, 25*b*, 25*c* and the outer conduit 12 are large then bending the wires 25*a*–25*c* around a tight radius so that they can be attached to the audio component or speaker is difficult. Accordingly, a preferred method of treating the ends of large diameter types of the outer conduit 12 is provided and is shown in FIG. 1.

It includes a first section of a flexible plastic tubing 32 that is disposed in each end of the outer conduit 12 a predetermined distance in from the end of the outer conduit. 12.

A second conduit 34, a third conduit 36, and a fourth conduit 38 are disposed over each of the first, second, and third wires 25*a*, 25*b*, 25*c* respectively and are each inserted into the end of the outer conduit 12 so as to be disposed within the first section of a flexible plastic tubing 32.

The outside circumference portion of first section of the flexible plastic tubing 32 is in contact with the inside diameter of the outer conduit 12 and the inside diameter circumference portion of the first section of the flexible plastic tubing 32 is in contact with and surrounds each of the second conduit 34, the third conduit 36, and the fourth conduit 38. The resulting spaces intermediate the second to fourth conduits 34, 36, 38 are small enough so as to normally prevent any of the ferro-electric substance 26 from escaping. If preferred, the glue or putty or filler may also be used to seal the intermediate spaces.

The second conduit 34, the third conduit 36, and the fourth conduit 38 extend a predetermined distance from the end of the outer conduit 12 and are contained by a section of heat shrink tubing 40 that is disposed inside of a second section of flexible plastic tubing 42. The second section of flexible plastic tubing 42 is generally the same size as the first section of flexible plastic tubing 32.

The second conduit 34, the third conduit 36, and the fourth conduit 38 end (terminate) inside of the second section of flexible plastic tubing 42.

A third section of flexible plastic tubing 44 is partially disposed inside of the second section of flexible plastic tubing 42 and extends therefrom a short distance.

The third section of flexible plastic tubing 44 must of necessity be smaller in diameter than either the first or third sections of flexible plastic tubing 32.

The first, second, and third wires 25*a*, 25*b*, 25*c* extend therefrom a predetermined distance and are stripped to reveal a portion of the first, second, and third electrical conductors 14, 16, 18. Any type of a termination, such as a spade fastener 46 may be attached to any of the first, second, and third electrical conductors 14, 16, 18, as desired.

The final seal is obtained by using a small amount of glue or by covering the entire end with a larger piece of heat shrink tubing (not shown).

The above described treatment for the end of a large diameter type of the outer conduit 12 is repeated at each end thereof.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A method for improving the quality of a signal transferred by an audio or video cable, which comprises:

(a) placing at least one electrical conductor in a conduit; and (b) including at least one ferro-electric substance in the conduit, said ferro-electric substance being adapted to affect the quality of said signal, said signal being an electrical waveform within a frequency range that occurs within the audible spectrum in said at least one electrical conductor sufficient to influence said quality to improve the listening thereof; and including the step of providing a seal at a first end of said conduit to retain said at least one ferro-electric substance in said conduit.

2. The method of claim 1 including the step of providing a seal at a second end of said conduit to retain said at least one ferro-electric substance in the conduit.

3. The method of claim 1 wherein the step of including at least one ferro-electric substance includes the step of combining a first ferro-electric substance with a second ferro-electric substance.

4. The method of claim 3 including the step of combining the first and the second ferro-electric substances together prior to the step of including them in said conduit.

5. The method of claim 1 wherein the step of including at least one ferro-electric substance includes a type of silicon dioxide.

6. The method of claim 1 wherein the step of including at least one ferro-electric substance includes a desiccant silica.

7. The method of claim 1 wherein the step of including at least one ferro-electric substance includes a rochelle salts.

* * * * *